US005632090A

United States Patent [19]

Smith

[11] Patent Number: 5,632,090

[45] Date of Patent: May 27, 1997

[54] DEGLAZING HAND TOOL

[76] Inventor: Richard A. Smith, 38 William Feather Dr., Voorhees, N.J. 08043

[21] Appl. No.: 546,931

[22] Filed: Oct. 23, 1995

[51] Int. Cl.[6] ..... B26B 3/08; A47L 1/06

[52] U.S. Cl. ..... 30/319; 15/236.1; 30/340

[58] Field of Search ..... 30/307, 319, 340, 30/306, 347; 15/236.1

[56] References Cited

U.S. PATENT DOCUMENTS 5,355,588 10/1994 Brandenberg et al. ..... 30/319

FOREIGN PATENT DOCUMENTS 2419859 11/1975 Germany ..... 30/319

*Primary Examiner*—Douglas D. Watts

*Attorney, Agent, or Firm*—Huntley & Associates

[57] ABSTRACT

A hand tool comprising an angular handle, a circular blade and a hand guard permits efficient removal of caulking in window units.

6 Claims, 3 Drawing Sheets

DEGLAZING HAND TOOL

BACKGROUND OF THE INVENTION

In the manufacture and repair of windows, the removal of glass from the sash has long been a tedious and time-consuming task. Cutting through the bedding material in order to remove the glass, particularly with manufactured window units that are fully glazed, is so time-consuming that, when a pane of glass is damaged in such constructions, it is often more economical to discard the entire manufactured window unit than to replace the glass. Accordingly, a continuing need exists for a tool for the efficient deglazing of window units.

SUMMARY OF THE INVENTION

The present invention provides an improved hand tool that can be used to cut through the bedding material and permits the removal of the glass from glazed window units in a fraction of the time previously required.

Specifically, the instant invention provides a hand tool comprising:

(a) an angular handle having front and rear sections, the front and rear sections of the handle being joined at an angle of about from 95 to 125 degrees;

(b) a circular blade rotatable mounted on the front end of the handle, the blade mounted substantially perpendicular to the axis of the front section of the handle, the center of the blade being recessed from the edges of the blade at least about 1/16 inch, the blade having a thickness of about from 0.025 to 0.125 inch; and (c) a hand guard for the rear section of the handle extending at least toward the interior of the angle formed by the front and rear sections of the handle.

DETAILED DESCRIPTION OF THE INVENTION

Figure 1:
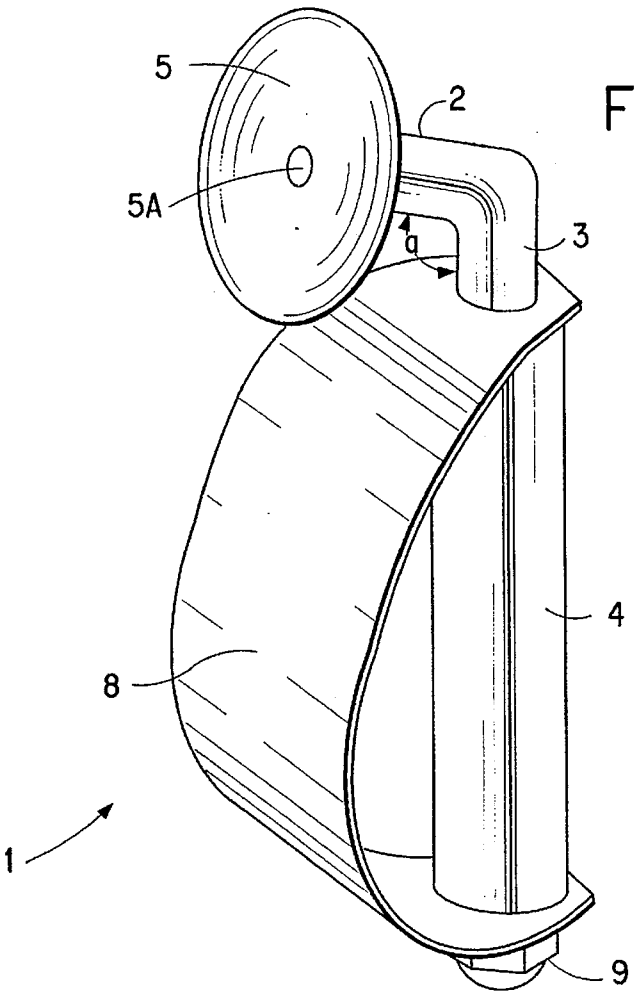
FIG. 1 is a perspective view of a hand tool of the invention.

The hand tool of the present invention comprises three basic components, these being an angular handle, a circular blade and a hand guard. These are illustrated in the drawings, in which FIG. 1 is a perspective view of a hand tool of the invention. There, angular handle 1, has front section 2 and rear section 3, the front and rear sections of the handle being joined at an angle "a" which is about from 95 to 125 degrees. In general, angles outside of this range have been found to provide unsatisfactory performance, from the standpoint of mechanical efficiency, caulk removal or comfort to the user.

The handle can be prepared from any suitable material. Aluminum rod stock has been found to be particularly convenient and satisfactory, for example, that having a diameter of about from 0.5 to 1 inches. As shown in the cross-sectional view illustrated in FIG. 2, the handle can be narrowed, as by machining, to accommodate the installation of a grip 4. The grip can be made of a wide variety of materials, of which wood and molded thermoplastic resin have been found to be particularly satisfactory.

Figure 2:
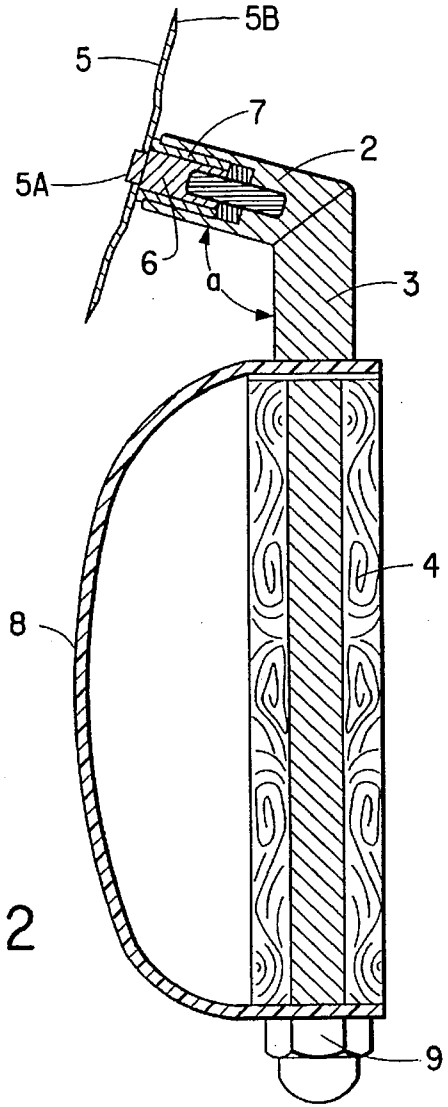
FIG. 2 is a longitudinal cross-sectional view of a hand tool of the invention.
Figure 3:
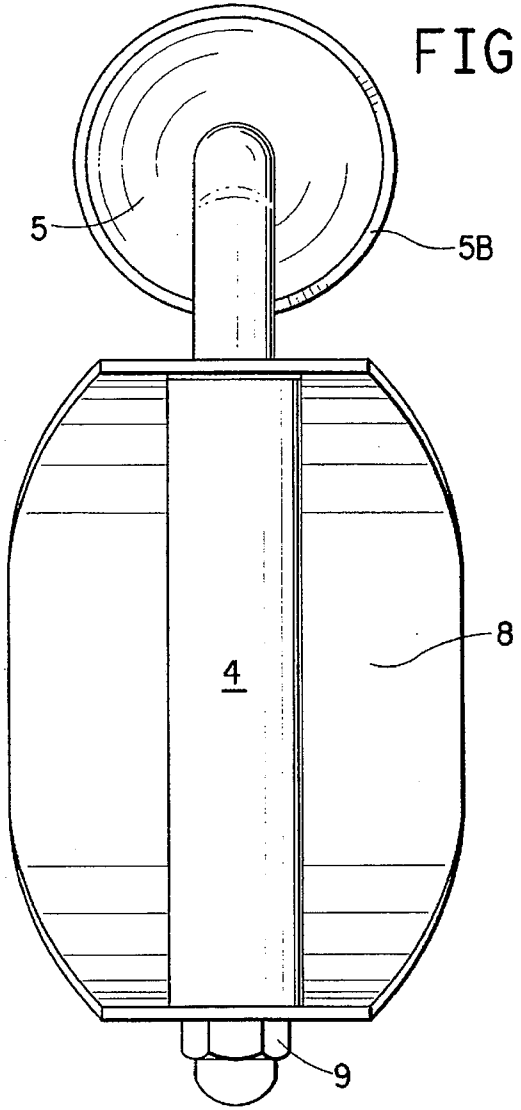
FIG. 3 is a top elevational view of a hand tool of the invention.
Figure 4:
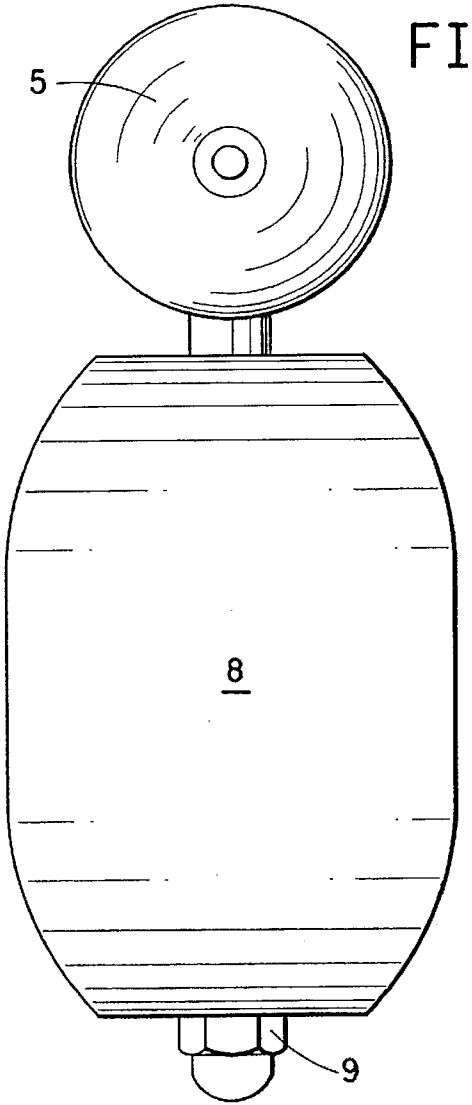
FIG. 4 is a fragmental side view of a hand tool of the invention.
Figure 5:
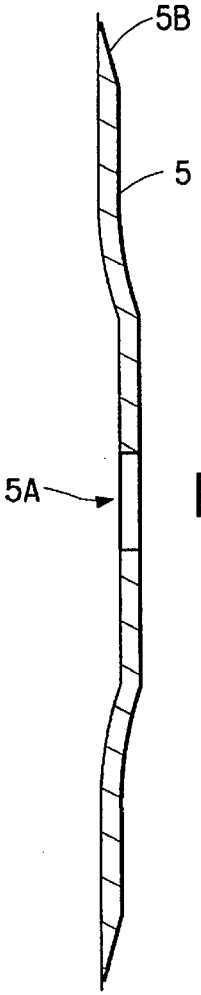
FIG. 5 is an enlarged cross-sectional view of a circular blade that can be used in the present invention.

Circular blade 5 is rotatably mounted on the front end of the handle, the blade being mounted substantially perpendicular to the axis of the front section of the handle. The means for mounting can vary widely, as will be evident to those skilled in the art. As shown here, the blade is attached to shaft 6, which is rotatably mounted in bearing 7. The bearing, in turn, is mounted within a recess formed in the front end of the handle, substantially parallel to the axis of the handle. As can be seen in FIGS. 2 and 5, the center 5A of the blade is recessed from the edges of the blade at least about 1/16 inch, to avoid scratching the glass on which the tool is used. The specific materials used for the circular blade are not critical to the present invention, and can be those normally used in blade manufacture, including, for example, ferrous alloys. Spring steel has been found to be particularly satisfactory, and is accordingly preferred.

The circumferential edge of the blade 5B is generally sharpened to an angle of less than about 20 degrees. The blade, in use, is largely self-sharpening, as the continual abrasion of the blade on the glass combined with the generally concave configuration of the blade, maintains a knife edge.

The handle is equipped with a hand guard 8, preferably in an arcuate configuration, for the rear section of the handle. The guard extends at least toward the interior of the angle formed by the front and rear sections of the handle. The guard protects the hand of the user from possible glass shards on the window surface. The guard can be conveniently made from a variety of sheet materials, of which high density polyethylenes, acrylics and polycarbonates have been found to be particularly satisfactory. The sheet material can be shaped at room temperature or elevated temperature, depending on the specific material used. The handle components are held together by appropriate fastening means 9.

Figure 6:
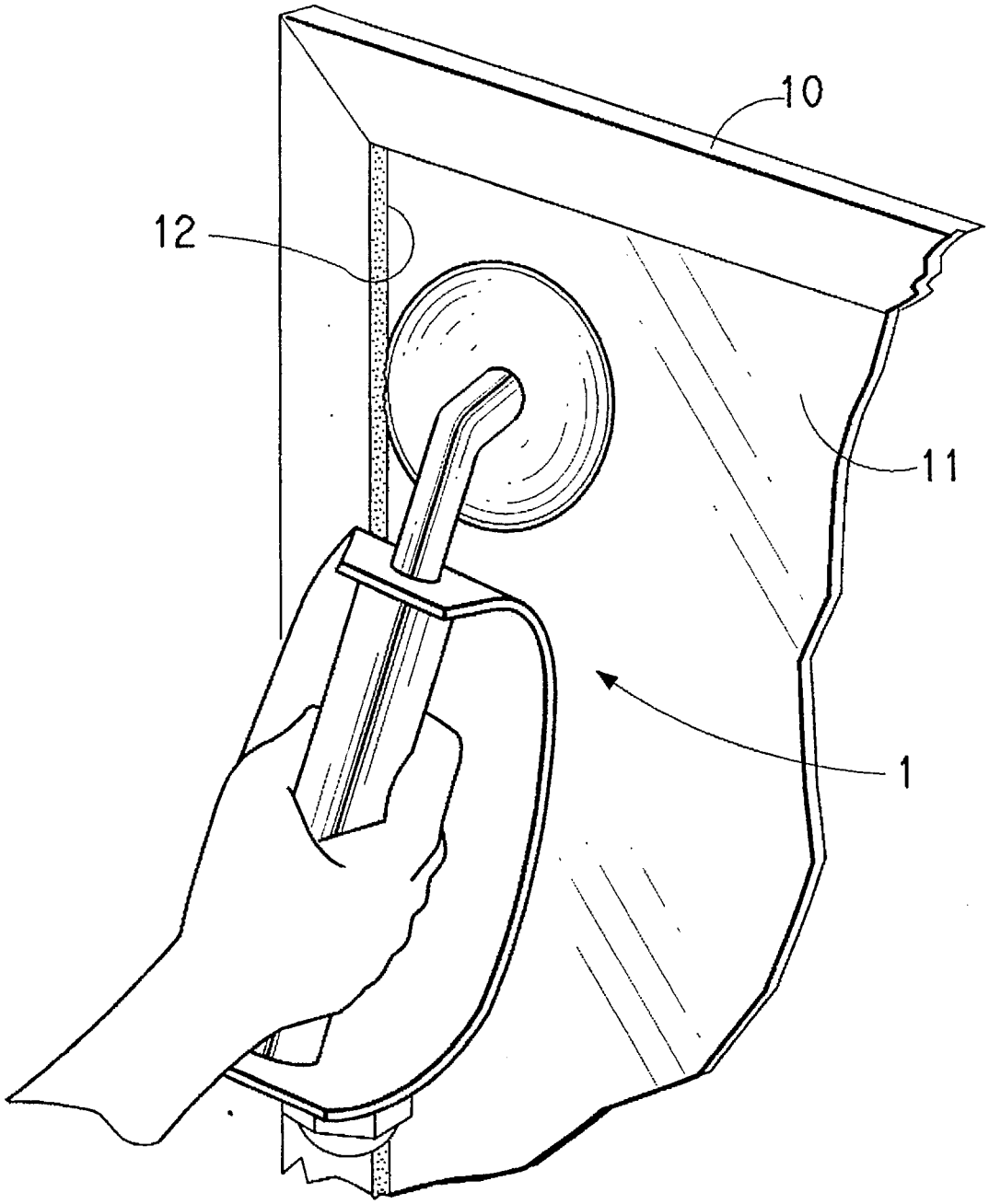
FIG. 6 is an illustration of the tool in operation.

The present invention can be used for the removal of a wide variety of caulks, glazing and bedding compounds, including, for example, silicone caulks, closed cell foam tape, urethanes, thermoplastics, and those made from butyl compounds. FIG. 6 shows use of the tool on a window comprising frame 10, glass 11 and caulk 12. In operation, the circular blade is generally first used flat to cut along the edge of the caulk adjacent the glass, as illustrated in FIG. 6, and then, if needed, inverted to make a second cut at an angle, after which the glass can be easily removed. In addition, the tool can be effectively used to remove perimeter caulking around window frames.

I claim:

1. A hand tool comprising:

(a) an angular handle having front and rear sections, the front and rear sections of the handle being joined at an angle of about from 95 to 125 degrees;

(b) a circular blade rotatable mounted on the front end of the handle, the blade mounted substantially perpendicular to the axis of the front section of the handle, the center of the blade being recessed from the edges of the blade at least about 1/16 inch, the blade having a thickness of about from 0.025 to 0.125 inch; and (c) a hand guard for the rear section of the handle extending at least toward the interior of the angle formed by the front and rear sections of the handle.

2. A hand tool of claim 1 wherein the front and rear sections of the handle are joined at an angle of about from 100 to 110 degrees.

3. A hand tool of claim 1 wherein circular blade has a diameter of about from 2 to 4 inches.

4. A hand tool of claim 3 wherein the circular blade has a diameter of about 2.5 inches.

5. A hand tool of claim 1 wherein the circular blade is made of spring steel.

6. A hand tool of claim 1 wherein the circular blade has circumferential knife edge having an angle of less than about 20 degrees.

* * * * *